US012635841B2

(12) United States Patent
Du et al.

(10) Patent No.: US 12,635,841 B2
(45) Date of Patent: May 26, 2026

(54) CONTROL METHOD FOR CLEANING ROBOT

(71) Applicant: Dreame Innovation Technology (Suzhou) Co., Ltd., Suzhou (CN)

(72) Inventors: Shuai Du, Suzhou (CN); Chenggang Xiong, Suzhou (CN); Shangtai Song, Suzhou (CN)

(73) Assignee: Dreame Innovation Technology (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 18/918,834

(22) Filed: Oct. 17, 2024

(65) Prior Publication Data

US 2025/0386989 A1 Dec. 25, 2025

(30) Foreign Application Priority Data

Jun. 19, 2024 (CN) ..... 202410790749.4

(51) Int. Cl.
*A47L 11/40* (2006.01)

(52) U.S. Cl.
CPC ..... *A47L 11/4011* (2013.01); *A47L 11/4036* (2013.01); *A47L 2201/06* (2013.01)

(58) Field of Classification Search
None
See application file for complete search history.

(56) References Cited

U.S. PATENT DOCUMENTS

| | | | | |
|---|---|---|---|---|
| 4,977,639 | A | 12/1990 | Takahashi | |
| 2019/0142237 | A1 | 5/2019 | Isenberg | |
| 2020/0023517 | A1 | 1/2020 | Cen | |
| 2020/0305672 | A1* | 10/2020 | Johnson | A47L 11/24 |

(Continued)

FOREIGN PATENT DOCUMENTS

| | | | |
|---|---|---|---|
| CN | 107744371 | A | 3/2018 |
| CN | 110733033 | A | 1/2020 |

(Continued)

OTHER PUBLICATIONS

Chinese First office action of Chinese application No. 202410790749.4 , mailed on Jul. 24, 2024.

(Continued)

*Primary Examiner* — Kaj K Olsen
*Assistant Examiner* — Pradhuman Parihar
(74) *Attorney, Agent, or Firm* — Womble Bond Dickinson (US) LLP

(57) ABSTRACT

The present disclosure provides a control method for cleaning robot, the method comprises: in case where a wet cleaning assembly performs a cleaning task on the operating surface at least in a mopping state, the cleaning robot is being hijacked and the time of being hijacked is greater than a preset time, the wet cleaning assembly changes from the mopping state to a mop folding state, wherein the being hijacked means that the cleaning robot leaves the operating surface; the cleaning robot quits being hijacked and continues to perform the cleaning task, in case where the operating surface is a floor or ceramic tile, the cleaning assembly switches from the mop folding state to the mopping state; in case where the operating surface is a carpet, the cleaning assembly remains in the mop folding state, the mopping state means that the mop is in the state of being released.

10 Claims, 2 Drawing Sheets

(56) References Cited

U.S. PATENT DOCUMENTS

| | | | | |
|---|---|---|---|---|
| 2021/0169296 | A1 | 6/2021 | Brown | |
| 2021/0228050 | A1 | 7/2021 | Zhang | |
| 2022/0079406 | A1* | 3/2022 | Zhang | A47L 11/4036 |
| 2022/0248930 | A1 | 8/2022 | Li | |
| 2023/0058513 | A1 | 2/2023 | Lee | |
| 2023/0404351 | A1* | 12/2023 | Qian | A47L 11/4041 |
| 2024/0029298 | A1 | 1/2024 | Luo et al. | |
| 2024/0066697 | A1 | 2/2024 | Cen | |
| 2024/0252011 | A1 | 8/2024 | Zheng | |
| 2025/0089966 | A1 | 3/2025 | Wang | |
| 2025/0176785 | A1 | 6/2025 | Sun | |

FOREIGN PATENT DOCUMENTS

| | | | |
|---|---|---|---|
| CN | 111035327 | A | 4/2020 |
| CN | 111345746 | A | 6/2020 |
| CN | 112741556 | A | 5/2021 |
| CN | 213963231 | U | 8/2021 |
| CN | 113712470 | A | 11/2021 |
| CN | 114098543 | B | 3/2022 |
| CN | 216495119 | U | 5/2022 |
| CN | 114587189 | A | 6/2022 |
| CN | 114587198 | A | 6/2022 |
| CN | 217118331 | U | 8/2022 |
| CN | 115087383 | A | 9/2022 |
| CN | 115316889 | A | 11/2022 |
| CN | 116509280 | A | 8/2023 |
| CN | 116784724 | A | 9/2023 |
| CN | 116869410 | A | 10/2023 |
| CN | 220494938 | U | 2/2024 |
| CN | 221153961 | U | 6/2024 |
| CN | 118356120 | A | 7/2024 |
| CN | 118948167 | A | 11/2024 |
| EP | 3900604 | A1 | 10/2021 |
| EP | 4342353 | A1 | 3/2024 |
| WO | 2019233493 | A1 | 12/2019 |
| WO | 2023193618 | A1 | 10/2023 |

OTHER PUBLICATIONS

Chinese Notice of Allowance of Chinese application No. 202410790749.4 , mailed on Aug. 29, 2024.

Extended European search report of European application No. 24206760.1 , mailed on Apr. 25, 2025.

Combined Search and Examination Report for GB2509349.3, Dec. 9, 2025, 6 pages.

International Search Report for PCT/CN2025/095039, Sep. 8, 2025, 5 pages.

Written Opinion for for PCT/CN2025/095039, Sep. 8, 2025, 6 pages.

* cited by examiner

CONTROL METHOD FOR CLEANING ROBOT

FIELD OF DISCLOSURE

The present disclosure belongs to the relative technical field of cleaning robot, and in particular, relates to a control method for cleaning robot.

DESCRIPTION OF RELATED ART

The cleaning robot currently comprises floor sweeping robot, mopping robot, sweeping and mopping integrated robot, floor washing machines, etc. The sweeping and mopping integrated robot not only can sweep the floor, but also can mop the floor, and becoming increasingly common in household life.

When performing sweeping task and mopping task, the cleaning robot typically cleans the floor in an orderly manner according to a preset cleaning path. During the normal process of cleaning the floor, there are instances where the cleaning robot is hijacked, such as the sweeping machine is lifted or forcefully dragged, enabling the sweeping machine cannot perform original cleaning task normally. When the hijacked situation disappears, the cleaning robot may lose position or status, under the condition of continuing to execute the cleaning tasks based on the position or status before the hijacking, it will often be inconsistent with the situation of the ground to be cleaned, not only the cleaning effect cannot be achieved, but also sometimes the secondary pollution will be caused, the cleaning efficiency is affected.

SUMMARY

The purpose of this disclosure is to provide a control method for cleaning robot that can at least solve one of the aforementioned technical problems. The specific plans are as follows:

According to the specific embodiment disclosed by the disclosure, the embodiment of the disclosure provides a control method for cleaning robot, the method comprises:

in case where a wet cleaning assembly of the cleaning robot performs a cleaning task on the operating surface at least in a mopping state, the cleaning robot is being hijacked and the time of being hijacked is greater than a preset time, the wet cleaning assembly of the cleaning robot changes from the mopping state to a mop folding state, wherein the being hijacked means that the cleaning robot leaves the operating surface, the mopping state means that the mop is in the state of being released;

the cleaning robot quits being hijacked and continues to perform the cleaning task, in case where the operating surface is a floor or ceramic tile, the wet cleaning assembly of the cleaning robot switches from the mop folding state to the mopping state; and in case where the operating surface is a carpet, the wet cleaning assembly of the cleaning robot remains in the mop folding state.

Art known by the inventor, in case where the cleaning robot walks into an area with many obstacles, the problem of hard to escape usually happens, at this time, the cleaning robot needs to be moved to a new position manually, after the cleaning robot of the present disclosure is hijacked, in order to prevent the cleaning robot from being placed on the ground to resume to perform cleaning task again, and prevent from contamination due to the state of the wet cleaning assembly is different from the material of the current ground, the wet cleaning assembly needs to be retracted firstly, after landing, judging whether to release the wet cleaning assembly to mop or not to release the wet cleaning assembly to sweep based on the material of the ground in case where the cleaning robot lands on the ground. However, the technical solution of the present disclosure provides a time threshold, that is to say, the wet cleaning assembly will not be retracted immediately after the cleaning robot is hijacked, but to wait until the time threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the preset time threshold is met, while the aforementioned drawbacks can be avoided maximumly, the accidents such as water tank leakage can be avoided by executing the operating command of retracting the wet cleaning assembly.

Optionally, the preset time is 0.5 s to 5 s. The preset time has a minimum time threshold to prevent the cleaning robot from being lifted off the ground due to misoperation, causing the cleaning robot to judge being in a hijacking state and execute hijacking command, thus affecting the normal cleaning task. It also avoids the situation where the wet cleaning assembly is quickly retracted after a short period of being lifted off the ground, which will increase the failure rate of the wet cleaning assembly and affect the lifespan of the wet cleaning assembly. During the mopping process of the cleaning device, due to the factors such as the ground is uneven, causing the cleaning device to bump, under the condition that the time threshold is not set, the cleaning device may lift off the ground in a very short time, such as within any tiny time interval of 0.1 s to 0.4 s, due to factors such as bumps and vibrations, under this scenario, on the condition that the cleaning robot recognizes this as a hijacking event, it will execute the action of retracting the mop, however, after the tiny time interval, the cleaning robot will execute judging step, and during this time, the material of the ground often does not change and remains the material of floor or ceramic tile that can be mopped, therefore, the action of releasing the mop for mopping the floor will be performed, this series of actions is too frequent, which will affect normal cleaning task, and will increase the failure rate of the wet cleaning assembly and affect the lifespan of the wet cleaning assembly, therefore, the application sets the time threshold to avoid the occurrence of this technical drawback.

The cleaning robot quits being hijacked and continues to perform the cleaning task, executing corresponding command according to the material of the operating surface, in case where the operating surface is a floor of ceramic tile, the wet cleaning assembly of the cleaning robot switches from the mop folding state to the mopping state; in case where the operating surface is a carpet, the wet cleaning assembly of the cleaning robot remains in the mop folding state; for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But for the operating surfaces such as the carpet, the mopping command cannot be executed, which will contaminate the carpet more easily, and only sweeping and vacuuming of the dry cleaning assembly can be performed. Therefore, in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises: the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state from the expanding state, and then changes from the mop folding state to the retracted mopping state.

Optionally, further comprising: in case where the wet cleaning assembly of the cleaning robot performs a cleaning task on the operating surface at least in a mopping state, and the cleaning robot is being hijacked and the time of being hijacked is greater than a preset time, a dry cleaning assembly of the cleaning robot switches from a sweeping state to a rotation stop state. Optionally, the dry cleaning assembly comprises a cleaning roller brush and a cleaning edge brush, the preset time for the cleaning roller brush to stop rotating is 0.5 to 2 s, or the preset time for the cleaning edge brush to stop rotating is 0.5 to 2 s. In case where the cleaning robot is being hijacked and the time of being hijacked is greater than a preset time, the dry cleaning assembly of the cleaning robot switches from the sweeping state to a rotation stop state, thus avoiding unnecessary waste of power consumption and avoiding the hand pinching accident caused by the continued rotation of the dry cleaning module under the hijacking state.

The embodiment of the present disclosure further provides a control method for cleaning robot, the method comprises:

in case where a wet cleaning assembly of the cleaning robot performs a cleaning task on the operating surface at least in a mopping state, the cleaning robot is being hijacked and the time of being hijacked is greater than a preset time, the wet cleaning assembly of the cleaning robot is in the mopping state, wherein the being hijacked means that the cleaning robot leaves the operating surface, the mopping state means that the mop is in the state of being released;

the cleaning robot quits being hijacked, the wet cleaning assembly of the cleaning robot switches from the mopping state to a mop folding state;

the cleaning robot continues to perform the cleaning task, in case where the operating surface is a floor or ceramic tile, the wet cleaning assembly of the cleaning robot switches from the mop folding state to the mopping state, in case where the operating surface is a carpet, the wet cleaning assembly of the cleaning robot remains in the mop folding state.

After the cleaning robot of the present disclosure is hijacked, in order to prevent the wet cleaning assembly from being damaged due to lift frequently, the wet cleaning assembly of the present disclosure does not perform lifting, the technical solution of the present disclosure provides a time threshold, that is to say, after the cleaning robot is hijacked, once the cleaning robot senses that it has left the ground, it can start timing using an internal timer, in case where the time of being hijacked exceeds the preset time, the wet cleaning assembly of the cleaning robot still stays in the mopping state and not to switch to the mop folding state. It can be seen that the cleaning robot has sensed that it is in an abnormal working state, but due to the cleaning device has left the operating surface at this time, it will not cause contamination to the operating surface, therefore it is unnecessary to retract the mop immediately, thus reducing the number of retracting which affect the lifespan of the retracting mechanism of the cleaning robot, and avoiding increasing the risk of pinching the hands due to multiple retraction and deployment.

In case where the cleaning robot judges that it has been hijacked and meets the threshold time, and the cleaning robot will not retract the wet cleaning assembly, to avoid affecting the lifespan of the wet cleaning assembly due to the frequent retraction and deployment, in addition, the multiple retraction and deployment of the wet cleaning assembly will also increase the risk of pinching the hands of the user easily.

Optionally, the preset time is 0.5 s to 5 s. The preset time has a minimum time threshold to prevent the cleaning robot from being lifted off the ground due to misoperation, causing the cleaning robot to judge being in a hijacking state and execute hijacking command, thus affecting the normal cleaning task. It also avoids the situation where the wet cleaning assembly is quickly retracted after a short period of being lifted off the ground, which will increase the failure rate of the wet cleaning assembly and affect the lifespan of the wet cleaning assembly. During the mopping process of the cleaning device, due to the factors such as the ground is uneven, causing the cleaning device to bump, under the condition that the time threshold is not set, the cleaning device may lift off the ground in a very short time, such as within any tiny time interval of 0.1 s to 0.4 s, due to factors such as bumps and vibrations, in case where lifting off the ground temporarily, on the condition that the cleaning robot recognizes this as a hijacking event, it will not execute the action of retracting the mop, however, after the tiny time interval (i.e. after landing), it will perform the mopping action, and then the judgment step will be performed immediately, at this time, the material of the ground will not change usually, and the floor or ceramic tile material that can be mopped will still continue, therefore, the cleaning robot will perform the releasing action of the mop, this series of actions is too frequent, which will affect normal cleaning task, and will increase the failure rate of the wet cleaning assembly and affect the lifespan of the wet cleaning assembly, therefore, the application sets the time threshold to avoid the occurrence of this technical drawback.

After the cleaning robot quits being hijacked, the cleaning robot is hijacked, the wet cleaning assembly of the cleaning robot switches from the mopping state to the mop folding state, that is no matter what the material of the ground is in case where the cleaning robot lands, the cleaning robot will retract the mop to avoid contaminating the material of the ground due to the unclear status of the ground material.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the mopping state from the expanding state, and then changes from the mop folding state to the retracted mopping state.

In case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state. It can be understood that, for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But for the operating surfaces such as the carpet, the mopping command cannot be executed, which will contaminate the carpet more easily, and only sweeping and vacuuming of the dry cleaning assembly can be performed. Therefore, in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

The embodiment of the present disclosure provides a control method for cleaning robot, the method comprises:

in case where a wet cleaning assembly of the cleaning robot performs a cleaning task on the operating surface at least in a mopping state, the cleaning robot is being hijacked, the wet cleaning assembly of the cleaning robot is in the mopping state, the being hijacked means that the cleaning robot is dragged from a first position to a second position, and the distance of being dragged from the first position to the second position is greater than a preset distance, or, the time of being dragged from the first position to the second position is greater than a preset time, the mopping state means that the mop is in the state of being released;

the cleaning robot quits being hijacked and continues to perform the cleaning task, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

In case where the cleaning robot judges that it has been hijacked, it will not retract the wet cleaning assembly immediately, but to wait until the time threshold or the distance threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the time threshold is met, while the aforementioned drawbacks can be avoided maximumly, the accidents such as water tank leakage can be avoided by executing the operating command of retracting the wet cleaning assembly.

Optionally, the preset time is 1 s to 10 s. The preset time has a minimum time threshold to avoid dragging the cleaning robot due to the misoperation, causing the cleaning robot to judge being in a hijacking state and execute hijacking command, thus affecting the normal cleaning task. It also avoids the situation where the wet cleaning assembly is quickly retracted after a short period of being dragged, and will increase the failure rate of the wet cleaning assembly and affect the lifespan of the wet cleaning assembly. During the process of mopping of the cleaning device, due to factors such as small animals touching, children playing, or people accidentally kicking, the cleaning device may be dragged on the ground for a short period of time, that is, the movement path is not the distance of the rotation of the driving wheel, but exceeds the distance of the rotation of the driving wheel, on the condition that the time threshold is not set, the cleaning device can be dragged in a very short time, such as within any tiny time interval of 2 s to 9 s, under this scenario, on the condition that the cleaning robot recognizes this as a hijacking event, it will execute the action of retracting the mop, however, after the tiny time interval, the cleaning robot will execute judging step, and during this time, the material of the ground often does not change and remains the material of floor or ceramic tile that can be mopped, therefore, the action of putting down the mop for mopping the floor will be performed, this series of actions is too frequent, which will affect normal cleaning task, and will increase the failure rate of the wet cleaning assembly and affect the lifespan of the wet cleaning assembly, therefore, the application sets the time threshold to avoid the occurrence of this technical drawback.

Optionally, the preset distance is 1 m to 2 m. The preset distance has a minimum distance threshold to avoid dragging the cleaning robot due to the misoperation, causing the cleaning robot to judge being in a hijacking state and execute hijacking command, thus affecting the normal cleaning task. It also avoids the situation where the wet cleaning assembly is quickly retracted after a short distance of being dragged, and will increase the failure rate of the wet cleaning assembly and affect the lifespan of the wet cleaning assembly. During the process of mopping of the cleaning device, due to factors such as small animals touching, children playing, or people accidentally kicking, the cleaning device may be dragged on the ground in a short distance, that is, the movement path is not the distance of the rotation of the driving wheel, but exceeds the distance of the rotation of the driving wheel, on the condition that the time threshold is not set, the cleaning device can be dragged in a very short distance, such as within any tiny distance of 0.1 m to 0.9 m, under this scenario, on the condition that the cleaning robot recognizes this as a hijacking event, it will execute the action of retracting the mop, however, after the tiny distance, the cleaning robot will execute judging step, and during this time, the material of the ground often does not change and remains the material of floor or ceramic tile that can be mopped, therefore, the action of putting down the mop for mopping the floor will be performed, this series of actions is too frequent, which will affect normal cleaning task, and will increase the failure rate of the wet cleaning assembly and affect the lifespan of the wet cleaning assembly, therefore, the application sets the distance threshold to avoid the occurrence of this technical drawback.

After the cleaning robot quits being hijacked, executing corresponding command according to the material of the operating surface, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But for the operating surfaces such as the carpet, the mopping command cannot be executed, which will contaminate the carpet more easily, and only sweeping and vacuuming of the dry cleaning assembly can be performed. Therefore, in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises: the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state within the range of the body of the cleaning robot from the expanding state, and then changes from the mop folding state to the retracted mopping state.

Optionally, further comprising: in case where the wet cleaning assembly of the cleaning robot performs a cleaning task on the operating surface at least in a mopping state, and the cleaning robot is hijacked, a dry cleaning assembly of the cleaning robot reduces the rotation speed after the preset time. Optionally, the dry cleaning assembly comprises a cleaning edge brush, the preset time for the cleaning edge brush to reduce the rotation speed is 1 to 5 s.

In case where the cleaning robot is hijacked, the dry cleaning assembly of the cleaning robot reduces the rotation speed after the preset time, in case where the cleaning robot quits being hijacked, the edge brush starts to resume to normal work. In case where the cleaning robot is dragged and hijacked, the blind cleaning of the edge brush can be reduced by slowing down the speed of the edge brush, such as in case where encountering pet feces or urine that are absolutely not suitable for cleaning during the process of dragging. In addition, it can also save the electricity and prolong the battery life, during the large area of dragging, the motor load can be reduced by lowing down the rotation speed of the edge brush, thus saving the electrical quantity consumption. This is very beneficial for increasing the driving range of the cleaning robot and extending the lifespan of the battery. In addition, it can also reduce noise interference, the high-speed rotating edge brush will produce a certain amount of noise. Reducing the rotation speed of the edge brush in case where dragging is required, the noise interference can be reduced, and the using experience with more quiet and comfortable can be provided. In addition, it can also prevent debris from splashing, the normal high-speed rotation of the edge brush can easily flick debris from the ground, causing secondary pollution. During the reduction of the rotation speed, it can effectively reduce this splashing phenomenon, making the cleaning more thorough. In addition, reducing the speed of the edge brush can protect it from being damaged, during the dragging process, the edge brush may encounter some obstacles or foreign objects. The lower rotation speed helps to avoid the edge brush getting entangled or wrapped, thus preventing damage.

The embodiment of the present disclosure provides a control method for cleaning robot, the method comprises:

in case where a wet cleaning assembly of the cleaning robot performs a cleaning task on the operating surface at least in a mopping state, the cleaning robot is being hijacked, the wet cleaning assembly of the cleaning robot is in the mopping state, the being hijacked means that the cleaning robot is dragged from the first position to the second position, and the distance of being dragged from the first position to the second position is greater than a preset distance, or, the time of being dragged from the first position to the second position is greater than a preset time, the mopping state means that the mop is in the state of being released;

the cleaning robot quits being hijacked, the cleaning robot is hijacked, the wet cleaning assembly of the cleaning robot switches from the mopping state to the mop folding state;

the cleaning robot continues to perform the cleaning task, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

Once the cleaning robot detects being dragged, it can start timing using an internal timer, at meantime recording the position through the position sensor, in case where the time of being hijacked exceeds the preset time, or, the distance of being hijacked exceeds the preset distance, the wet cleaning assembly of the cleaning robot still stays in the mopping state and not to switch to the mop folding state. It can be seen that the cleaning robot has sensed that it is in an abnormal working state, but due to the cleaning device is in the process of being dragged, on the condition that executing the action of retracting, it may cause harm to the person who is dragging, therefore it is unnecessary to retract the mop immediately, avoiding increasing the risk of pinching the hands due to multiple retraction and deployment.

In case where the cleaning robot judges that it has been hijacked and meets the threshold time of the threshold distance, and the cleaning robot will not retract the wet cleaning assembly, to avoid affecting the lifespan of the wet cleaning assembly due to the frequent retraction and deployment, in addition, the multiple retraction and deployment of the wet cleaning assembly will also increase the risk of pinching the hands of the user easily.

Optionally, the preset time is 1 s to 10 s. The preset time has a minimum time threshold to prevent the cleaning robot from being dragged due to misoperation, causing the cleaning robot to judge being in a hijacking state and execute hijacking command, thus affecting the normal cleaning task. During the process of mopping of the cleaning device, due to factors such as small animals touching, children playing, or people accidentally kicking, the cleaning device may be dragged on the ground in a short time, that is, the movement path is not the distance of the rotation of the driving wheel, but exceeds the distance of the rotation of the driving wheel, on the condition that the time threshold is not set, the cleaning device can be dragged in a very short time, such as within any tiny period of 2 s to 5 s, under this scenario, on the condition that the cleaning robot recognizes whether this is a hijacking event frequently, it will cause the waste of the resource. Moreover, after the tiny period, the cleaning robot will execute the lifting control logic of the wet cleaning assembly based on its judgment structure, at this time, the material of the ground often does not change and remains the material of floor or ceramic tile that can be mopped, therefore, after this series of judgment and analysis, the action of the wet cleaning assembly remains unchanged, which wastes the resources used for judgment and may affect the normal cleaning tasks. Therefore, the present disclosure sets time judging threshold, only in case where it is greater than the threshold, the judgment logic is executed, the judgment resources will not be wasted, thus the cleaning efficiency will not be affected.

Optionally, the preset distance is 1 m to 2 m. The preset time has a minimum distance threshold to avoid dragging the cleaning robot due to the misoperation, causing the cleaning robot to judge being in a hijacking state and execute hijacking command, thus affecting the normal cleaning task. During the process of mopping of the cleaning device, due to factors such as small animals touching, children playing, or people accidentally kicking, the cleaning device may be dragged on the ground in a short distance, that is, the movement path is not the distance of the rotation of the driving wheel, but exceeds the distance of the rotation of the driving wheel, on the condition that the time threshold is not set, the cleaning device can be dragged in a very short distance, such as within any tiny distance of 0.1 m to 0.5 m, under this scenario, on the condition that the cleaning robot recognizes whether this is a hijacking event frequently, it will cause the waste of the resource. Moreover, after the tiny distance, the cleaning robot will execute the lifting control logic of the wet cleaning assembly based on its judgment structure, at this time, the material of the ground often does not change and remains the material of floor or ceramic tile that can be mopped, therefore, after this series of judgment and analysis, the action of the wet cleaning assembly remains unchanged, which wastes the resources used for judgment and may affect the normal cleaning tasks. Therefore, the present disclosure sets distance judging threshold, only in case where it is greater than the threshold, the judgment logic is executed, the judgment resources will not be wasted, thus the cleaning efficiency will not be affected.

After the cleaning robot quits being hijacked, the cleaning robot is hijacked, the wet cleaning assembly of the cleaning robot switches from the mopping state to the mop folding state, that is no matter what the material of the ground is in case where the cleaning robot finishes being dragged, the cleaning robot will retract the mop to avoid contaminating the material of the ground due to the unclear status of the ground material.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the mopping state from the expanding state, and then changes from the mop folding state to the retracted mopping state.

In case where the cleaning robot quits being hijacked, executing correspondent operation command according to the material of the ground after retracting the wet cleaning assembly. In case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But for the operating surfaces such as the carpet, the mopping command cannot be executed, which will contaminate the carpet more easily, and only sweeping and vacuuming of the dry cleaning assembly can be performed. Therefore, in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

The embodiment of the present disclosure provides a control method for cleaning robot, the method comprises:

in case where a wet cleaning assembly of the cleaning robot performs a cleaning task on the operating surface at least in a mopping state, the cleaning robot is being hijacked, the wet cleaning assembly of the cleaning robot switches from the mopping state to the mop folding state, the being hijacked means that the time that one side of a driving wheel of the cleaning robot leaves the operating surface is greater than a preset time, or the distance that one side of the driving wheel leaves the operating surface is greater than a preset distance, the mopping state means that the mop is in the state of being released;

the cleaning robot quits being hijacked and continues to perform the cleaning task, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

After the cleaning robot of the present disclosure is hijacked, in order to prevent one side of the driving wheel from returning to the ground to resume to perform cleaning task again, and prevent from contamination due to the state of the wet cleaning assembly is different from the material of the current ground, the wet cleaning assembly needs to be retracted firstly, after landing, judging whether to release the wet cleaning assembly to mop or not to release the wet cleaning assembly to sweep based on the material of the ground in case where the cleaning robot lands on the ground. However, the technical solution of the present disclosure provides a time threshold, that is to say, the wet cleaning assembly will not be retracted immediately after the cleaning robot is hijacked, but to wait until the time threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the time threshold or distance threshold is met, while the aforementioned drawbacks can be avoided maximumly, the accidents such as water tank leakage can be avoided by executing the operating command of retracting the wet cleaning assembly.

Optionally, the preset time is 2 s to 6 s. The preset time has a minimum time threshold to avoid one side of the cleaning robot being lifted due to misoperation, causing the cleaning robot to judge being in a hijacking state and execute hijacking command, thus affecting the normal cleaning task. It also avoids the situation where the wet cleaning assembly is quickly retracted after a short period of one side of the cleaning robot is lifted, which will increase the failure rate of the wet cleaning assembly and affect the lifespan of the wet cleaning assembly. During the mopping process of the cleaning device, due to the factors such as the ground is uneven, causing the cleaning device to bump, under the condition that the time threshold is not set, the cleaning device may lift off the ground in a very short time, such as within any tiny time interval of 0.1 s to 0.4 s, due to factors such as bumps and vibrations, under this scenario, on the condition that the cleaning robot recognizes this as a hijacking event, it will execute the action of retracting the mop, however, after the tiny time interval, the cleaning robot will execute judging step, and during this time, the material of the ground often does not change and remains the material of floor or ceramic tile that can be mopped, therefore, the action of putting down the mop for mopping the floor will be performed, this series of actions is too frequent, which will affect normal cleaning task, and will increase the failure rate of the wet cleaning assembly and affect the lifespan of the wet cleaning assembly, therefore, the application sets the time threshold to avoid the occurrence of this technical drawback.

Optionally, the preset distance is 2 cm to 20 cm. The preset distance has a minimum distance threshold to avoid one side of the cleaning robot being lifted due to the misoperation or the bump, causing the cleaning robot to judge being in a hijacking state and execute hijacking command, thus affecting the normal cleaning task. It also avoids the situation where the wet cleaning assembly is quickly retracted after a short distance of being lifted, and will increase the failure rate of the wet cleaning assembly and affect the lifespan of the wet cleaning assembly. During the process of mopping of the cleaning device, due to factors such as the ground is uneven, causing the cleaning device to bump, under the condition that the distance threshold is not set, one side of the driving wheel of the cleaning robot may lift off the ground in a very short distance, such as within any tiny distance interval of 1 cm to 1.4 cm, due to factors such as bumps and vibrations, under this scenario, on the condition that the cleaning robot recognizes this as a hijacking event, it will execute the action of retracting the mop, however, after the tiny distance, the cleaning robot will execute judging step, and during this time, the material of the ground often does not change and remains the material of floor or ceramic tile that can be mopped, therefore, the action of putting down the mop for mopping the floor will be performed, this series of actions is too frequent, which will affect normal cleaning task, and will increase the failure rate of the wet cleaning assembly and affect the lifespan of the wet cleaning assembly, therefore, the application sets the distance threshold to avoid the occurrence of this technical drawback.

After the cleaning robot quits being hijacked, executing corresponding command according to the material of the operating surface, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But for the operating surfaces such as the carpet, the mopping command cannot be executed, which will contaminate the carpet more easily, and only sweeping and vacuuming of the dry cleaning assembly can be performed. Therefore, in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises: the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state from the expanding state, and then changes from the mop folding state to the retracted mopping state.

The embodiment of the present disclosure provides a control method for cleaning robot, the method comprises:

in case where a wet cleaning assembly of the cleaning robot performs a cleaning task on the operating surface at least in a mopping state, the cleaning robot is being hijacked, the wet cleaning assembly of the cleaning robot switches from the mopping state to the mop folding state, wherein, the being hijacked means that the time of the cleaning robot staying in original position under an external force is greater than a preset time, the mopping state means that the mop is in the state of being released;

the cleaning robot quits being hijacked, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

In case where the cleaning robot judges that it has been hijacked, it will not retract the wet cleaning assembly immediately, but to wait until the time threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the preset time threshold is met, while the aforementioned drawbacks can be avoided maximumly, the accidents such as water tank leakage can be avoided by executing the operating command of retracting the wet cleaning assembly.

Optionally, the preset time is 1 s to 10 s. The preset time has a minimum time threshold to avoid dragging the cleaning robot due to the misoperation, causing the cleaning robot to judge being in a hijacking state and execute hijacking command, thus affecting the normal cleaning task. It also avoids the situation where the wet cleaning assembly is quickly retracted after a short period of being dragged, and will increase the failure rate of the wet cleaning assembly and affect the lifespan of the wet cleaning assembly. During the process of mopping of the cleaning device, due to factors such as small animals touching, children playing, or people accidentally kicking, the cleaning device may be dragged on the ground for a short period of time, that is, the movement path is not the distance of the rotation of the driving wheel, but exceeds the distance of the rotation of the driving wheel, on the condition that the time threshold is not set, the cleaning device can be dragged in a very short time, such as within any tiny time interval of 2 s to 9 s, under this scenario, on the condition that the cleaning robot recognizes this as a hijacking event, it will execute the action of retracting the mop, however, after the tiny time interval, the cleaning robot will execute judging step, and during this time, the material of the ground often does not change and remains the material of floor or ceramic tile that can be mopped, therefore, the action of putting down the mop for mopping the floor will be performed, this series of actions is too frequent, which will affect normal cleaning task, and will increase the failure rate of the wet cleaning assembly and affect the lifespan of the wet cleaning assembly, therefore, the application sets the time threshold to avoid the occurrence of this technical drawback.

After the cleaning robot quits being hijacked, executing corresponding command according to the material of the operating surface, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But for the operating surfaces such as the carpet, the mopping command cannot be executed, which will contaminate the carpet more easily, and only sweeping and vacuuming of the dry cleaning assembly can be performed. Therefore in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises: the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, for example, the wet cleaning assembly cannot be retracted due to being stuck by the solid object, therefore it is necessary to enable the wet cleaning assembly to retract to the mopping state from the expanding state, and then changes from the mop folding state to the retracted mopping state.

Optionally, further comprising: in case where the wet cleaning assembly of the cleaning robot performs a cleaning task on the operating surface at least in a mopping state, and the cleaning robot is hijacked, a dry cleaning assembly of the cleaning robot reduces the rotation speed after a first preset time. Optionally, the dry cleaning assembly comprises a cleaning edge brush, the first preset time for the cleaning edge brush to reduce the rotation speed is 1 to 5 s. In case where the cleaning robot is hijacked, a dry cleaning assembly of the cleaning robot reduces the rotation speed after the preset time, in case where the cleaning robot quits being hijacked, the edge brush starts to resume to normal work. In case where the cleaning robot is dragged and hijacked, by slowing down the speed of the edge brush can save the electricity and prolong the battery life, during the large area of dragging, the motor load can be reduced by lowing down the rotation speed of the edge brush, thus saving the electrical quantity consumption. This is very beneficial for increasing the driving range of the cleaning robot and extending the lifespan of the battery. In addition, it can also reduce noise interference, the high-speed rotating edge brush will produce a certain amount of noise. After lowing down the rotation speed of the edge brush, it can reduce the noise interference, and provide more quiet and comfortable using experience. In addition, it can also prevent debris from splashing, the normal high-speed rotation of the edge brush can easily flick debris from the ground, causing secondary pollution. During the reduction of the rotation speed, it can effectively reduce this splashing phenomenon, making the cleaning more thorough.

Optionally, further comprising: the dry cleaning assembly of the cleaning robot stops rotating after a second preset time. Optionally, the second preset time for the cleaning edge brush to stop rotating is 25 to 35s. In case where the cleaning robot is hijacked, after the dry cleaning assembly of the cleaning robot reducing the rotation speed for a period of time, the edge brush stops rotating, can further save the electricity and prolong the battery life, the motor load can be reduced by stopping rotating, thus saving the electrical quantity consumption. This is very beneficial for increasing the driving range of the cleaning robot and extending the lifespan of the battery. In addition, it can also reduce noise interference, the high-speed rotating edge brush will produce a certain amount of noise. After the edge brush stops rotating, it can reduce the noise interference, and provide more quiet and comfortable using experience.

Optionally, further comprising: the dry cleaning assembly of the cleaning robot increases the rotation speed after reducing the rotation speed. Optionally, in case where the wet cleaning assembly of the cleaning robot performs a cleaning task on the operating surface at least in a mopping state, and after the cleaning robot is being hijacked, the driving wheel of the cleaning robot accelerates in the range of a third preset time to escape from the hijacked state. Optionally, in case where the driving wheel of the cleaning robot does not escape from the hijacked state in the range of the third preset time, stops rotating after a fourth preset time.

After the cleaning robot is pressed at the original position, the cleaning robot will automatically enter the escape mode, at this time, the driving wheel of the cleaning robot will accelerate to prevent from being hijacked due to unexpected obstruction, during the process of implementing escaping process, the driving wheel can enhance the force of escaping after accelerating, the cleaning robot will escape on the condition of accidental obstruction, thus solving the misjudgment caused by unexpected obstruction. After executing escape for a period of time, it may indeed be in the hijacking state on the condition that the cleaning robot cannot escape, the driving wheel stops rotating to reduce unnecessary power consumption and low down the noise.

BRIEF DESCRIPTION OF DRAWINGS

In order to more clearly illustrate the embodiments of the present disclosure or the technical solutions in the existing art, the accompanying drawings required in the description of the embodiments or the existing art are briefly described beneath, obviously, the accompanying drawings in the following description are some embodiments of the present disclosure, for those of ordinary skill in the art, other accompanying drawings can be obtained according to these accompanying drawings without exerting creative efforts.

DETAILED DESCRIPTION OF IMPLEMENTATIONS

Figure 1:
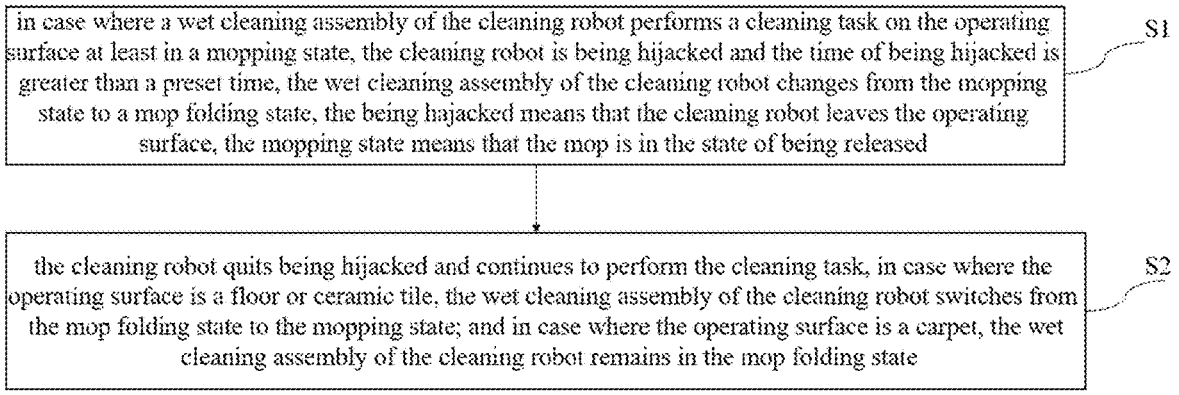
FIG. 1 is a flow chart of a control method for cleaning robot provided by an embodiment of the present disclosure.

The technical solutions of the present disclosure will be clearly and completely described below in conjunction with the accompanying drawings. Obviously, the described embodiments are part of the embodiments of the present disclosure, not all of the embodiments. The present disclosure will be described in detail below in conjunction with embodiments with reference to the accompanying drawings. It should be noted that, as long as there is no conflict, the embodiments and features in the embodiments of the present disclosure can be combined with each other.

It should be noted that the terms “first”, “second”, etc. in the description and claims of the present disclosure and the above-mentioned drawings are used to distinguish similar objects and are not necessarily used to describe a specific order or sequence.

It should also be noted that the terms “comprises”, “comprising” or any other variation thereof are intended to cover a non-exclusive inclusion, such that a good or apparatus including a list of elements includes not only those elements but also those not expressly listed other elements, or elements inherent to such goods or devices. Without further limitation, an element defined by the statement “comprises a” does not exclude the presence of other identical elements in the goods or devices including the stated element.

The application provides a control method for cleaning robot, there are no specific constraints on the structure of the cleaning robot, for example, the cleaning robot can be a floor washing robot, a mopping robot, a sweeping robot, a sweeping and mopping integrated robot, etc., the present disclosure takes the sweeping and mopping integrated robot as an example to illustrate.

The cleaning robot can comprise a robot body, the robot body is provided with a control unit and a driving unit, etc., the control unit can control the driving unit to enable the robot to move automatically, the robot body is equipped with a cleaning assembly, etc., the control unit can control the cleaning assembly to work. The cleaning assembly can comprise a wet cleaning assembly and a dry cleaning assembly, the wet cleaning assembly can comprise a mopping assembly, it can be understood that the mopping assembly should be understood in a broad sense and can comprise flat mop, rolling brush mop etc. Optionally, the wet cleaning assembly is provided with a lifting function, the wet cleaning assembly with the lifting function is released when performing task, to mop or wash the floor after contacting with the ground, and lifting off the ground after finishing the cleaning. Optionally, the wet cleaning assembly is further provided with an expanding function, in case where the wet cleaning assembly is released to mop the floor, it can extend outside the robot body to expand the working range, in case where the cleaning task is finished, at least part of the wet cleaning assembly retracts inside the robot body, to avoid second contamination to the ground. The dry cleaning assembly can comprise assemblies such as a rolling brush, an edge brush, and a fan, etc., to sweep and collect the dry waste on the floor, for example, dry cleaning assembly can be used to clean carpet floors, dry cleaning assembly is usually not provided with a lifting function.

Optionally, the robot body is further provided with many types of sensor assembly, the control unit control the cleaning robot to execute correspondent action according to the data detected by the sensor assembly, the control unit can control the cleaning robot to move forward, backward, turn, etc. The sensor assembly comprises but not limited to a position sensor, a collision sensor, an attitude sensor, a drop sensor, etc., the position sensor can obtain the position coordinate of the cleaning robot in due time, and determine to execute cleaning command according to the coordinate. The collision sensor can provide a collision force data of the cleaning robot to control the cleaning robot whether to avoid obstacles or not. The attitude sensor can monitor the attitude of the cleaning robot and can send attitude parameters such as normal, tilt, tilt angle, tilt time, etc. to the control unit. The attitude sensor can be gyroscope, accelerometer, etc. The drop sensor can monitor whether the cleaning robot is in a suspending state to determine whether it is likely to fall ahead.

As shown in FIG. 1, the present disclosure provides a control method for cleaning robot, the cleaning robot executes corresponding control instructions based on at least the hardware structure as described above, the method comprises:

S1: in case where a wet cleaning assembly of the cleaning robot performs a cleaning task on the operating surface at least in a mopping state, the cleaning robot is being hijacked and the time of being hijacked is greater than a preset time, the wet cleaning assembly of the cleaning robot changes from the mopping state to a mop folding state, wherein the being hijacked means that the cleaning robot leaves the operating surface, the mopping state means that the mop is in the state of being released; it can be understood that the mopping state described in the present disclosure means that the mop is in the state of being released should be understood in a broad sense, relative to the mop folding, for example, the mop driving structure enables the mop to stay in the putting down state, it does not only mean working on the operating surface, wherein, the mop folding state can be understood as the state of the mop is lifted actively or passively, usually in case where the mop is in the folding state, it will not contact with the operating surface, which is relative to the mop stays in the putting down state.

S2: the cleaning robot quits being hijacked and continues to perform the cleaning task, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

In case where the cleaning robot is performing the cleaning task, it performs the cleaning according to the preset cleaning path, for the step S1, the cleaning robot mops the floor by the wet cleaning assembly, in addition, being hijacked under the action of external force, the being hijacked means that the cleaning robot lifts off the ground completely, that is to say, the cleaning robot does not contact with the operating surface, the judgement of the hijacking state is obtained by the aforementioned sensor or other common sensor, which will not be described here again. Once the cleaning robot senses that it has left the ground, it can start timing using an internal timer, in case where the time of being hijacked exceeds the preset time, the wet cleaning assembly of the cleaning robot still stays in the mopping state and not to switch to the mop folding state. It can be seen that the cleaning robot has sensed that it is in an abnormal working state, thus retracting the mop from the putting down state to wait to execute the subsequent command.

For the step S1, in case where the cleaning robot judges that it has been hijacked, it will not retract the wet assembly immediately, but to wait until the time threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the preset time threshold is met, while the aforementioned drawbacks can be avoided maximumly, the accidents such as water tank leakage can be avoided by executing the operating command of retracting the wet cleaning assembly.

Optionally, the preset time is 0.5 s to 5 s. The preset time has a minimum time threshold, such as set any value between 0.5 s and 5 s, which can be 1 s, 1.5 s, 2.3 s, 2.5 s, 3 s, 3.5 s, 4 s. To prevent the cleaning robot from being lifted off the ground due to misoperation, causing the cleaning robot to judge being in a hijacking state and execute hijacking command, thus affecting the normal cleaning task.

For the step S2: the cleaning robot quits being hijacked, usually needs to judge according to the aforementioned sensor assembly, in case where the sensor assembly judges that the cleaning robot changes from the lifting off ground state to the landing state within the preset time, the hijacking event is considered to be finished.

The cleaning robot quits being hijacked and continues to perform the cleaning task, executing corresponding command according to the material of the operating surface, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; the judgement of the material of the operating surface can combine with relative technology to understand, for example, it can analysis and judge through the image of the operating surface captured by a camera, it can also analysis and judge through a optical sensor, or through an acoustic wave sensor or ultrasonic wave, etc., and there is no limit to this. It can be understood that, for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But to the operating surfaces such as the carpet, the mopping command cannot be executed, which will contaminate the carpet more easily, and only sweeping and vacuuming of the dry cleaning assembly can be performed. Therefore in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state within the range of the body of the cleaning robot from the expanding state, and then changes from the mop folding state to the retracted mopping state.

Optionally, further comprising: in case where the wet cleaning assembly of the cleaning robot performs a cleaning task on the operating surface at least in a mopping state, and the cleaning robot is being hijacked and the time of being hijacked is greater than a preset time, a dry cleaning assembly of the cleaning robot switches from a sweeping state to a rotation stop state.

Optionally, the dry cleaning assembly comprises a cleaning roller brush and a cleaning edge brush, the preset time for the cleaning roller brush to stop rotating is 0.5 to 2 s, or the preset time for the cleaning edge brush to stop rotating is 0.5 to 2 s.

In the embodiment of the present disclosure, in case where the wet cleaning assembly of the cleaning robot is performing the cleaning task on the operating surface in the mopping state, once the cleaning robot is hijacked to leave the operating surface for more than the preset time, the wet cleaning assembly of the cleaning robot changes from the mopping state to a mop folding state, avoiding contamination to the operating surface caused by the water tank leakage. In case where the cleaning robot quits being hijacked, the cleaning robot controls the wet cleaning assembly to release to mop the floor or continue to remain folding state according to the material of the operating surface, to adapt to the material of the current operating surface and avoid contaminating the carpet.

Figure 2:
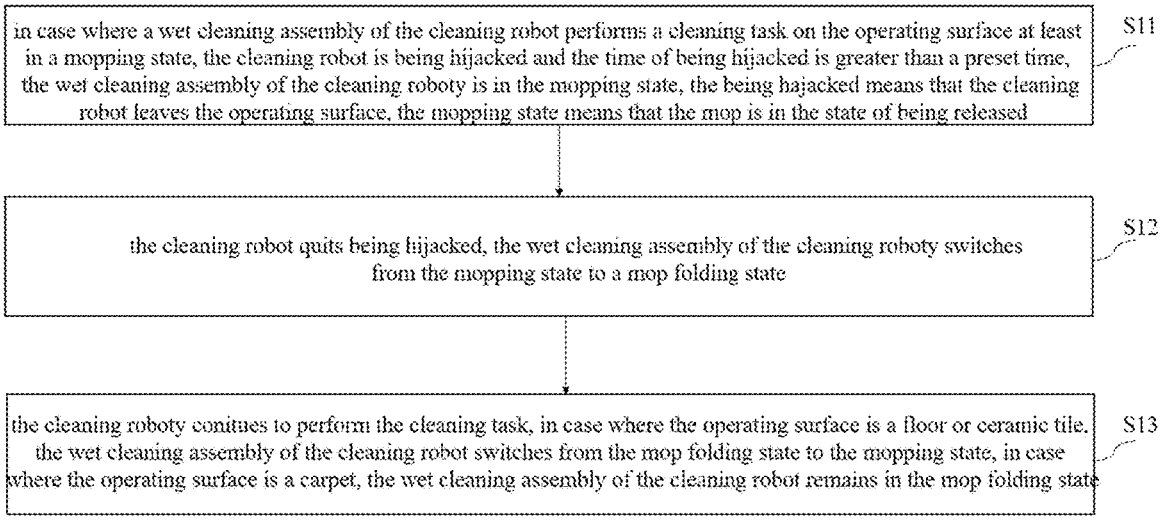
FIG. 2 is a flow chart of a control method for cleaning robot provided by another embodiment of the present disclosure.

As shown in FIG. 2, the present disclosure provides a control method for cleaning robot, the cleaning robot executes corresponding control instructions based on at least the hardware structure as described above, the method comprises:

S11: in case where a wet cleaning assembly of the cleaning robot performs a cleaning task on the operating surface at least in a mopping state, the cleaning robot is being hijacked and the time of being hijacked is greater than a preset time, the wet cleaning assembly of the cleaning robot is in the mopping state, wherein the being hijacked means that the cleaning robot leaves the operating surface, the mopping state means that the mop is in the state of being released;

S12: the cleaning robot quits being hijacked, the wet cleaning assembly of the cleaning robot switches from the mopping state to a mop folding state;

S13: the cleaning robot continues to perform the cleaning task, in case where the operating surface is a floor or ceramic tile, the wet cleaning assembly of the cleaning robot switches from the mop folding state to the mopping state, in case where the operating surface is a carpet, the wet cleaning assembly of the cleaning robot remains in the mop folding state.

In case where the cleaning robot is performing the cleaning task, it performs the cleaning according to the preset cleaning path, for the step S11, the cleaning robot mops the floor by the wet cleaning assembly, in addition, hijacked under the action of external force, the being hijacked means that the cleaning robot lifts off the ground completely, that is to say, the cleaning robot does not contact with the operating surface, the judgement of the hijacking state is obtained by the aforementioned sensor or other common sensor, which will not be described here again. Once the cleaning robot senses that it has left the ground, it can start timing using an internal timer, in case where the time of being hijacked exceeds the preset time, the wet cleaning assembly of the cleaning robot still stays in the mopping state and not to switch to the mop folding state. It can be seen that the cleaning robot has sensed that it is in an abnormal working state, but due to the cleaning device has left the operating surface at this time, it will not cause contamination to the operating surface, therefore it is unnecessary to retract the mop immediately, thus reducing the number of retracting which affect the lifespan of the retracting mechanism of the cleaning robot, and avoiding increasing the risk of pinching the hands due to multiple retraction and deployment.

For the step S11, in case where the cleaning robot judges that it has been hijacked and meets the threshold time, and the cleaning robot will not retract the wet cleaning assembly, to avoid affecting the lifespan of the wet cleaning assembly due to the frequent retraction and deployment, in addition, the multiple retraction and deployment of the wet cleaning assembly will also increase the risk of pinching the hands of the user easily.

Optionally, the preset time is 0.5 s to 5 s. The preset time has a minimum time threshold, such as set any value between 0.5 s and 5 s, which can be 1.2 s, 2.3 s, 4.5 s. To prevent the cleaning robot from being lifted off the ground due to misoperation, causing the cleaning robot to judge being in a hijacking state and execute hijacking command, thus affecting the normal cleaning task.

For the step S12: the cleaning robot quits being hijacked, usually needs to judge according to the aforementioned sensor assembly, in case where the sensor assembly judges that the cleaning robot changes from the lifting off ground state to the landing state within the preset time, the hijacking event is considered to be finished.

After the cleaning robot quits being hijacked, the cleaning robot is hijacked, the wet cleaning assembly of the cleaning robot switches from the mopping state to the mop folding state, that is no matter what the material of the ground is in case where the cleaning robot lands, the cleaning robot will retract the mop to avoid contaminating the material of the ground due to the unclear status of the ground material.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the mopping state from the expanding state, and then changes from the mop folding state to the retracted mopping state.

In case where the cleaning robot quits being hijacked, executing correspondent operation command according to the material of the ground after retracting the wet cleaning assembly. In case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; the judgement of the material of the operating surface can combine with relative technology to understand, for example, it can analysis and judge through the image of the operating surface captured by a camera, it can also analysis and judge through a optical sensor, or through an acoustic wave sensor or ultrasonic wave, etc., and there is no limit to this. It can be understood that, for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But to the operating surfaces such as the carpet, the mopping command cannot be executed, which will contaminate the carpet more easily, and only sweeping and vacuuming of the dry cleaning assembly can be performed. Therefore in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, further comprising: in case where the wet cleaning assembly of the cleaning robot performs a cleaning task on the operating surface at least in a mopping state, and the cleaning robot is being hijacked and the time of being hijacked is greater than a preset time, a dry cleaning assembly of the cleaning robot switches from a sweeping state to a rotation stop state.

Optionally, the dry cleaning assembly comprises a cleaning roller brush and a cleaning edge brush, the preset time for the cleaning roller brush to stop rotating is 0.5 to 2 s, or the preset time for the cleaning edge brush to stop rotating is 0.5 to 2 s.

In the embodiment of the present disclosure, in case where the wet cleaning assembly of the cleaning robot is performing the cleaning task on the operating surface in the mopping state, once the cleaning robot is hijacked to leave the operating surface for more than the preset time, the wet cleaning assembly of the cleaning robot remains the mopping state unchanged, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user. In case where the cleaning robot quits being hijacked, the cleaning robot retracts the wet cleaning assembly firstly and immediately, avoid contaminating the operating surface due to the material of the operating surface is not clear. Then the cleaning robot controls the wet cleaning assembly to release to mop the floor or continue to remain folding state according to the material of the operating surface, to adapt to the material of the current operating surface and avoid contaminating the carpet.

Figure 3:
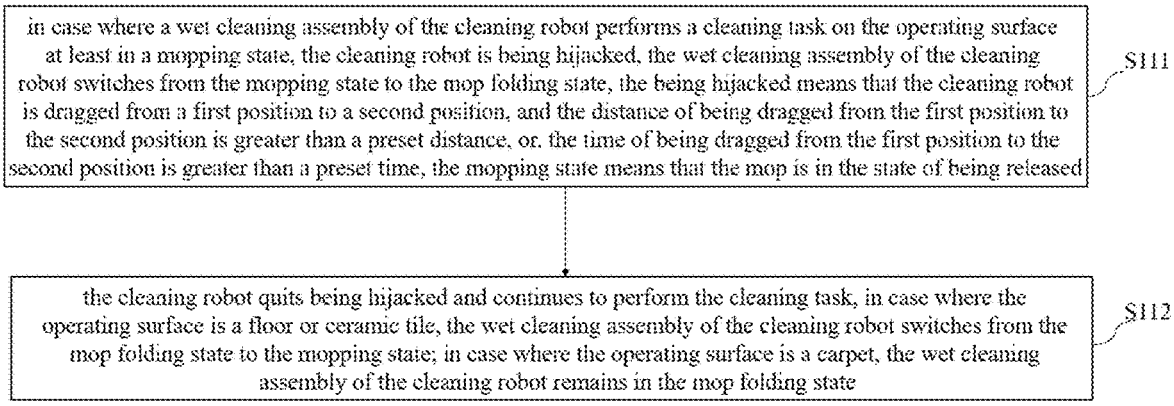
FIG. 3 is a flow chart of a control method for cleaning robot provided by another embodiment of the present disclosure.

As shown in FIG. 3, the present disclosure provides a control method for cleaning robot, the cleaning robot executes corresponding control instructions based on at least the hardware structure as described above, the method comprises:

S111: in case where a wet cleaning assembly of the cleaning robot performs a cleaning task on the operating surface at least in a mopping state, the cleaning robot is hijacked, the wet cleaning assembly of the cleaning robot is in the mopping state, the being hijacked means that the cleaning robot is dragged from the first position to the second position, and the distance of being dragged from the first position to the second position is greater than a preset distance, or, the time of being dragged from the first position to the second position is greater than a preset time, the mopping state means that the mop is in the state of being released;

S112: the cleaning robot quits being hijacked and continues to perform the cleaning task, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

In case where the cleaning robot is performing the cleaning task, it performs the cleaning according to the preset cleaning path, for the step S111, the cleaning robot mops the floor by the wet cleaning assembly, in addition, hijacked under the action of external force, the being hijacked means that the cleaning robot is dragged from the first position to the second position, the judgement of the hijacking state is obtained by the aforementioned sensor or other common sensor, which will not be described here again. Once the cleaning robot detects being dragged, it can start timing using an internal timer, at meantime recording the position through the position sensor, in case where the time of being hijacked exceeds the preset time, or, the distance of being hijacked exceeds the preset distance, the wet cleaning assembly of the cleaning robot switches from the mopping state to the mop folding state. It can be seen that the cleaning robot has sensed that it is in an abnormal working state, thus retracting the mop from the putting down state to wait to execute the subsequent command.

For the step S111, in case where the cleaning robot judges that it has been hijacked, it will not retract the wet cleaning assembly immediately, but to wait until the time threshold or the distance threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the time threshold is met, while the aforementioned drawbacks can be avoided maximumly, the accidents such as water tank leakage can be avoided by executing the operating command of retracting the wet cleaning assembly.

Optionally, the preset time is 1 s to 10 s. The preset time has a minimum time threshold, such as set any value between 1 s and 10 s, which can be 2 s, 3 s, 4 s, 5 s, 6 s, 7 s, 8 s, 9 s, 10 s. To prevent the cleaning robot from being dragged due to misoperation, causing the cleaning robot to judge being in a hijacking state and execute hijacking command, thus affecting the normal cleaning task. It also avoids the situation where the wet cleaning assembly is quickly retracted after a short period of being dragged, and will increase the failure rate of the wet cleaning assembly and affect the lifespan of the wet cleaning assembly.

Optionally, the preset distance is 1 m to 2 m. The preset distance has a minimum distance threshold, such as 1 m, to avoid dragging the cleaning robot due to the misoperation, causing the cleaning robot to judge being in a hijacking state and execute hijacking command, thus affecting the normal cleaning task. It also avoids the situation where the wet cleaning assembly is quickly retracted after a short distance of being dragged, and will increase the failure rate of the wet cleaning assembly and affect the lifespan of the wet cleaning assembly.

For the step S112: the cleaning robot quits being hijacked, it usually judges according to the aforementioned sensor assembly, in case where the sensor assembly judges the cleaning robot has finished the dragging state, the hijacking event is considered to be finished.

After the cleaning robot quits being hijacked, executing corresponding command according to the material of the operating surface, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; the judgement of the material of the operating surface can combine with relative technology to understand, for example, it can analysis and judge through the image of the operating surface captured by a camera, it can also analysis and judge through a optical sensor, or through an acoustic wave sensor or ultrasonic wave, etc., and there is no limit to this. It can be understood that, for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But to the operating surfaces such as the carpet, the mopping command cannot be executed, which will contaminate the carpet more easily, and only sweeping and vacuuming of the dry cleaning assembly can be performed. Therefore in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state within the range of the body of the cleaning robot from the expanding state, and then changes from the mop folding state to the retracted mopping state.

Optionally, further comprising: in case where the wet cleaning assembly of the cleaning robot performs a cleaning task on the operating surface at least in a mopping state, and the cleaning robot is hijacked, a dry cleaning assembly of the cleaning robot reduces the rotation speed after the preset time.

Optionally, the dry cleaning assembly comprises a cleaning edge brush, the preset time for the cleaning edge brush to reduce the rotation speed is 1 to 5 s.

In the embodiment of the present disclosure, in case where the wet cleaning assembly of the cleaning robot is performing the cleaning task on the operating surface in the mopping state, once the distance being hijacked and dragged is greater than the preset distance of the time being dragged is greater than the preset time, the wet cleaning assembly of the cleaning robot changes from the mopping state to a mop folding state, avoiding contamination to the operating surface caused by the water tank leakage. In case where the cleaning robot quits being hijacked, the cleaning robot controls the wet cleaning assembly to release to mop the floor or continue to remain folding state according to the material of the operating surface, to adapt to the material of the current operating surface and avoid contaminating the carpet.

Figure 4:
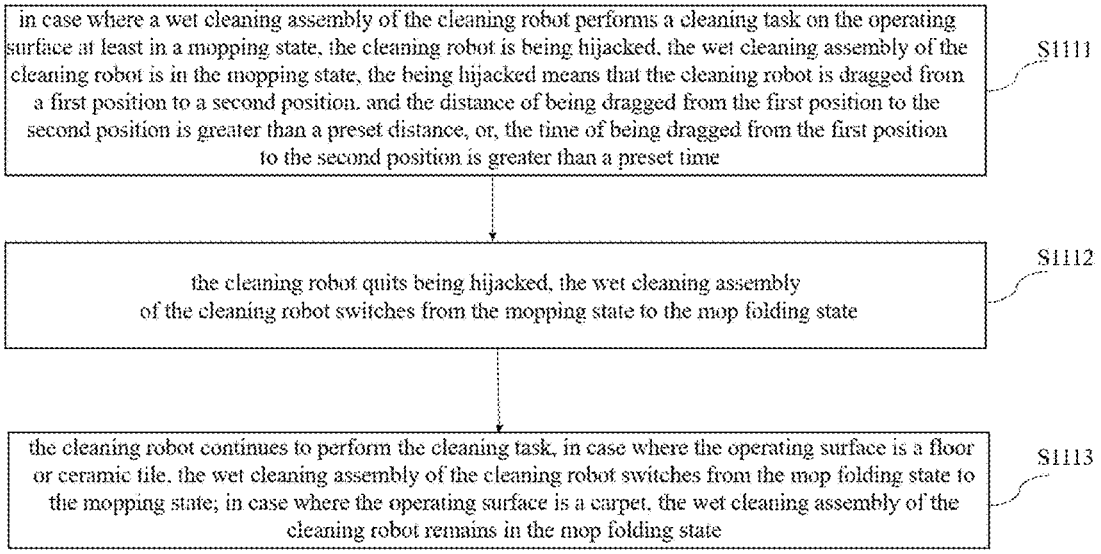
FIG. 4 is a flow chart of a control method for cleaning robot provided by another embodiment of the present disclosure.

As shown in FIG. 4, the present disclosure provides a control method for cleaning robot, the cleaning robot executes corresponding control instructions based on at least the hardware structure as described above, the method comprises:

S1111: in case where a wet cleaning assembly of the cleaning robot performs a cleaning task on the operating surface at least in a mopping state, the cleaning robot is hijacked, the wet cleaning assembly of the cleaning robot is in the mopping state, the being hijacked means that the cleaning robot is dragged from the first position to the second position, and the distance of being dragged from the first position to the second position is greater than a preset distance, or, the time of being dragged from the first position to the second position is greater than a preset time, the mopping state means that the mop is in the state of being released;

S1112: the cleaning robot quits being hijacked, the cleaning robot is hijacked, the wet cleaning assembly of the cleaning robot switches from the mopping state to the mop folding state;

S1113: the cleaning robot continues to perform the cleaning task, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

In case where the cleaning robot is performing the cleaning task, it performs the cleaning according to the preset cleaning path, for the step S1111, the cleaning robot mops the floor by the wet cleaning assembly, in addition, hijacked under the action of external force, the being hijacked means that the cleaning robot is dragged from the first position to the second position, the judgement of the hijacking state is obtained by the aforementioned sensor or other common sensor, which will not be described here again. Once the cleaning robot detects being dragged, it can start timing using an internal timer, at meantime recording the position through the position sensor, in case where the time of being hijacked exceeds the preset time, or, the distance of being hijacked exceeds the preset distance, the wet cleaning assembly of the cleaning robot still stays in the mopping state and not to switch to the mop folding state. It can be seen that the cleaning robot has sensed that it is in an abnormal working state, but due to the cleaning device is in the process of being dragged, on the condition that executing the action of retracting, it may cause harm to the person who is dragging, therefore it is unnecessary to retract the mop immediately, avoiding increasing the risk of pinching the hands due to multiple retraction and deployment.

For the step S1111, in case where the cleaning robot judges that it has been hijacked and meets the threshold time of the threshold distance, and the cleaning robot will not retract the wet cleaning assembly, to avoid affecting the lifespan of the wet cleaning assembly due to the frequent retraction and deployment, in addition, the multiple retraction and deployment of the wet cleaning assembly will also increase the risk of pinching the hands of the user easily.

Optionally, the preset time is 1 s to 10 s. The preset time has a minimum time threshold, such as set any value between 1 s and 10 s, which can be 2 s, 3 s, 4 s, 5 s, 6 s, 7 s, 8 s, 9 s. To avoid dragging the cleaning robot due to the misoperation, causing the cleaning robot to judge being in a hijacking state and execute hijacking command, thus affecting the normal cleaning task. It also avoids the situation where the wet cleaning assembly is quickly retracted after a short period of being dragged, and will increase the failure rate of the wet cleaning assembly and affect the lifespan of the wet cleaning assembly.

Optionally, the preset distance is 1 m to 2 m. The preset distance has a minimum distance threshold, such as 1 m, to avoid dragging the cleaning robot due to the misoperation, causing the cleaning robot to judge being in a hijacking state and execute hijacking command, thus affecting the normal cleaning task. It also avoids the situation where the wet cleaning assembly is quickly retracted after a short distance of being dragged, and will increase the failure rate of the wet cleaning assembly and affect the lifespan of the wet cleaning assembly.

For the step S1112: the cleaning robot quits being hijacked, it usually judges according to the aforementioned sensor assembly, in case where the sensor assembly judges the cleaning robot has finished the being dragged state, the hijacking event is considered to be finished.

After the cleaning robot quits being hijacked, the cleaning robot is hijacked, the wet cleaning assembly of the cleaning robot switches from the mopping state to the mop folding state, that is no matter what the material of the ground is in case where the cleaning robot finishes being dragged, the cleaning robot will retract the mop to avoid contaminating the material of the ground due to the unclear status of the ground material.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state from the expanding state, and then changes from the mop folding state to the retracted mopping state.

For the step S1113: in case where the cleaning robot quits being hijacked, executing correspondent operation command according to the material of the ground after retracting the wet cleaning assembly. In case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; the judgement of the material of the operating surface can combine with relative technology to understand, for example, it can analysis and judge through the image of the operating surface captured by a camera, it can also analysis and judge through a optical sensor, or through an acoustic wave sensor or ultrasonic wave, etc., and there is no limit to this. It can be understood that, for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But to the operating surfaces such as the carpet, the mopping command cannot be executed, which will contaminate the carpet more easily, and only sweeping and vacuuming of the dry cleaning assembly can be performed. Therefore in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, further comprising: in case where the wet cleaning assembly of the cleaning robot performs a cleaning task on the operating surface at least in a mopping state, and the cleaning robot is hijacked, a dry cleaning assembly of the cleaning robot reduces the rotation speed after the preset time.

Optionally, the dry cleaning assembly comprises a cleaning edge brush, the preset time for the cleaning edge brush to reduce the rotation speed is 1 to 5 s.

In the embodiment of the present disclosure, in case where the wet cleaning assembly of the cleaning robot is performing the cleaning task on the operating surface in the mopping state, once the cleaning robot is hijacked for more than the preset time or the preset distance, the wet cleaning assembly of the cleaning robot remains the mopping state unchanged, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user. In case where the cleaning robot quits being hijacked, the cleaning robot retracts the wet cleaning assembly firstly and immediately, avoid contaminating the operating surface due to the material of the operating surface is not clear. Then the cleaning robot controls the wet cleaning assembly to release to mop the floor or continue to remain folding state according to the material of the operating surface, to adapt to the material of the current operating surface and avoid contaminating the carpet.

Figure 5:
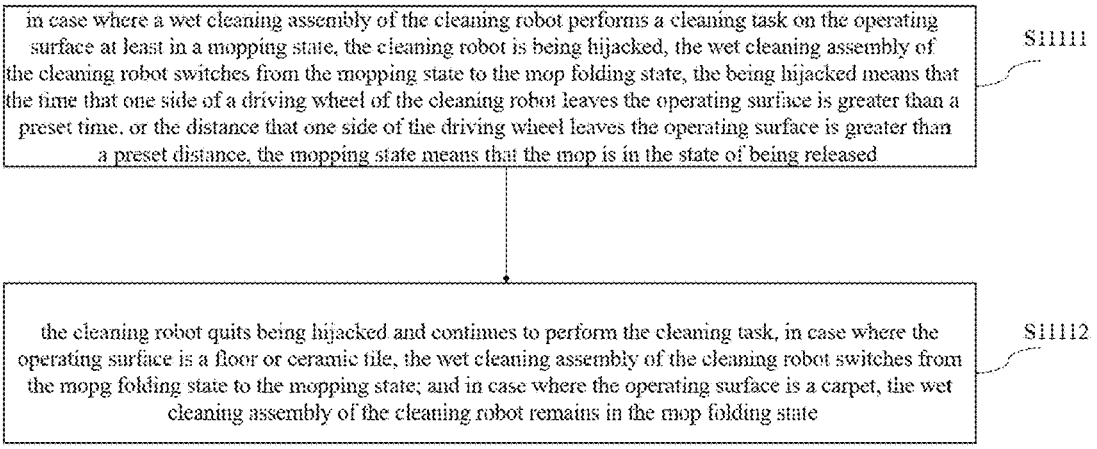
FIG. 5 is a flow chart of a control method for cleaning robot provided by another embodiment of the present disclosure.

As shown in FIG. 5, the present disclosure provides a control method for cleaning robot, the cleaning robot executes corresponding control instructions based on at least the hardware structure as described above, the method comprises:

S11111: in case where a wet cleaning assembly of the cleaning robot performs a cleaning task on the operating surface at least in a mopping state, the cleaning robot is hijacked, the wet cleaning assembly of the cleaning robot switches from the mopping state to the mop folding state, the being hijacked means that the time that one side of a driving wheel of the cleaning robot leaves the operating surface is greater than a preset time, or the distance that one side of the driving wheel leaves the operating surface is greater than a preset distance, the mopping state means that the mop is in the state of being released;

S11112: the cleaning robot quits being hijacked and continues to perform the cleaning task, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

For the step S11111, the cleaning robot mops the floor by the wet cleaning assembly, in addition, hijacked under the action of external force, such as children lift one side of the driving wheel of the robot due to the reason of curiosity. The being hijacked means that the time that one side of a driving wheel of the cleaning robot leaves the operating surface is greater than a preset time, or the distance that one side of the driving wheel leaves the operating surface is greater than a preset distance, the judgement of the hijacking state is obtained by the aforementioned sensor or other common sensor, which will not be described here again. Once one side of the cleaning robot is lifted, it can start timing using an internal timer, at meantime recording the position through the position sensor, in case where the time of being hijacked exceeds the preset time, or, the distance of being hijacked exceeds the preset distance, the wet cleaning assembly of the cleaning robot switches from the mopping state to the mop folding state. It can be seen that the cleaning robot has sensed that it is in an abnormal working state, thus retracting the mop from the putting down state to wait to execute the subsequent command.

For the step S11111, in case where the cleaning robot judges that it has been hijacked, it will not retract the wet cleaning assembly immediately, but to wait until the time threshold or the distance threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the time threshold is met, while the aforementioned drawbacks can be avoided maximumly, the accidents such as water tank leakage can be avoided by executing the operating command of retracting the wet cleaning assembly.

Optionally, the preset time is 2 s to 6 s. The preset time has a minimum time threshold, such as 2 s, 3 s, 4 s, 5 s, to avoid one side of the cleaning robot being lifted due to misoperation, causing the cleaning robot to judge being in a hijacking state and execute hijacking command, thus affecting the normal cleaning task. It also avoids the situation where the wet cleaning assembly is quickly retracted after a short period of one side of the cleaning robot is lifted, which will increase the failure rate of the wet cleaning assembly and affect the lifespan of the wet cleaning assembly.

Optionally, the preset distance is 2 cm to 20 cm. The preset distance has a minimum distance threshold, such as 2 cm, 4 cm, 6 cm, 8 cm, 10 cm, 12 cm, 14 cm, 16 cm, to avoid one side of the cleaning robot being lifted due to the misoperation or the bump, causing the cleaning robot to judge being in a hijacking state and execute hijacking command, thus affecting the normal cleaning task. It also avoids the situation where the wet cleaning assembly is quickly retracted after a short distance of being lifted, and will increase the failure rate of the wet cleaning assembly and affect the lifespan of the wet cleaning assembly.

For the step S11112: the cleaning robot quits being hijacked, it usually judges according to the aforementioned sensor assembly, in case where the sensor assembly judges the cleaning robot has finished the dragging state, the hijacking event is considered to be finished.

After the cleaning robot quits being hijacked, executing corresponding command according to the material of the operating surface, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; the judgement of the material of the operating surface can combine with relative technology to understand, for example, it can analysis and judge through the image of the operating surface captured by a camera, it can also analysis and judge through a optical sensor, or through an acoustic wave sensor or ultrasonic wave, etc., and there is no limit to this. It can be understood that, for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But to the operating surfaces such as the carpet, the mopping command cannot be executed, which will contaminate the carpet more easily, and only sweeping and vacuuming of the dry cleaning assembly can be performed. Therefore in order to enable the cleaning robot to execute correct cleaning command after finishing being hijacked, the state of the wet cleaning assembly must be controlled according to the material of the operating surface at the current position, in case where the operating surface is a floor of ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state from the expanding state, and then changes from the mop folding state to the retracted mopping state.

In the embodiment of the present disclosure, in case where the wet cleaning assembly of the cleaning robot is performing the cleaning task on the operating surface in the mopping state, once the distance being hijacked is greater than the preset distance or the time being hijacked is greater than the preset time, the wet cleaning assembly of the cleaning robot changes from the mopping state to a mop folding state, avoiding contamination to the operating surface caused by the water tank leakage. In case where the cleaning robot quits being hijacked, the cleaning robot controls the wet cleaning assembly to release to mop the floor or continue to remain folding state according to the material of the operating surface, to adapt to the material of the current operating surface and avoid contaminating the carpet.

Figure 6:
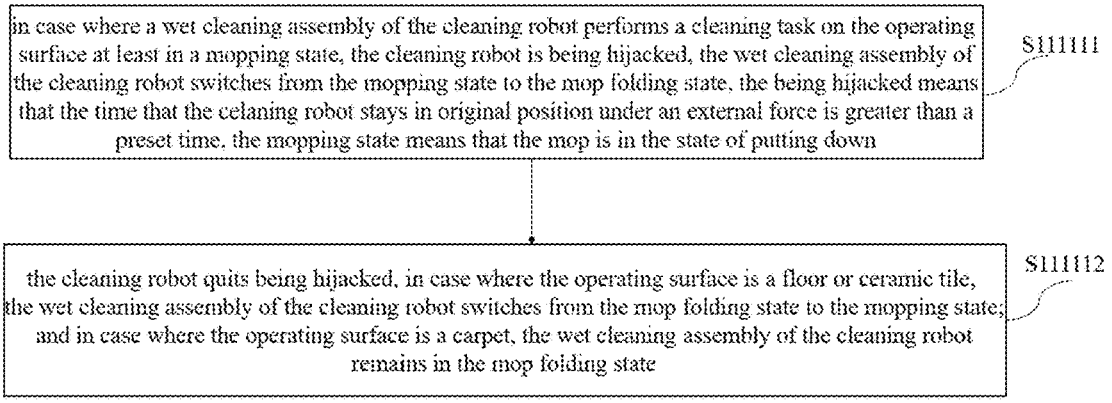
FIG. 6 is a flow chart of a control method for cleaning robot provided by another embodiment of the present disclosure.

As shown in FIG. 6, the present disclosure provides a control method for cleaning robot, the cleaning robot executes corresponding control instructions based on at least the hardware structure as described above, the method comprises:

S111111: in case where a wet cleaning assembly of the cleaning robot performs a cleaning task on the operating surface at least in a mopping state, the cleaning robot is hijacked, the wet cleaning assembly of the cleaning robot switches from the mopping state to the mop folding state, the being hijacked means that the time of the cleaning robot staying in original position under an external force is greater than a preset time, the mopping state means that the mop is in the state of being released;

S111112: the cleaning robot quits being hijacked, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state.

In case where the cleaning robot is performing the cleaning task, it performs the cleaning according to the preset cleaning path, for the step S111111, the cleaning robot mops the floor by the wet cleaning assembly, at this time, under the action of the external force, the being hijacked means that the time of the cleaning robot being pressed to stay in the original position is greater than a preset time, the judgement of the hijacking state is obtained by the aforementioned sensor or other common sensor, which will not be described here again. The cleaning robot is pressed, for example, the cleaning robot may be pressed to stay in the original position due to the elderly people does not know how to use or the children play, the cleaning robot is pressed, it can start timing using an internal timer, in case where the time of being hijacked exceeds the preset time, the wet cleaning assembly of the cleaning robot still stays in the mopping state and not to switch to the mop folding state. It can be seen that the cleaning robot has sensed that it is in an abnormal working state, thus retracting the mop from the putting down state to wait to execute the subsequent command.

For the step S111111, in case where the cleaning robot judges that it has been hijacked, it will not retract the wet cleaning assembly immediately, but to wait until the time threshold is met before performing the retracting action, to avoid affecting the lifespan of the wet cleaning assembly due to the frequent retraction and deployment of the wet cleaning assembly, in addition, multiple retraction and deployment of the wet cleaning assembly can easily increase the risk of pinching the hands of the user, performing the retracting command after the preset time threshold is met, while the aforementioned drawbacks can be avoided maximumly, the accidents such as water tank leakage can be avoided by executing the operating command of retracting the wet cleaning assembly.

Wherein, the being hijacked means that the cleaning robot is pressed to stay in original position under an external force, stay in original position means that within a circumference of 1 to 5 cm around the body of the cleaning robot, which is not necessarily fixed in original position, because in case where being pressed, the cleaning robot will control the driving wheel to accelerate to escape from being trapped, it is difficult for external force to keep the robot completely still, so the position will shift to a certain extent.

Optionally, the preset time is 1 s to 10 s. The preset time has a minimum time threshold, such as 2 s, 3 s, 4 s, 5 s, 6 s, 7 s, 8 s, 9 s. To avoid the cleaning robot from becoming immobile due to get stuck, causing the cleaning robot to judge being in a hijacking state and execute hijacking command, thus affecting the normal cleaning task. It also avoids the situation where the wet cleaning assembly is quickly retracted after a short period of being dragged, and will increase the failure rate of the wet cleaning assembly and affect the lifespan of the wet cleaning assembly.

For the step S111112: the cleaning robot quits being hijacked, it usually judges according to the aforementioned sensor assembly, in case where the sensor assembly judges the cleaning robot has finished the dragging state, the hijacking event is considered to be finished.

After the cleaning robot quits being hijacked, executing corresponding command according to the material of the operating surface, in case where the operating surface is a floor or ceramic tile, the wet cleaning assembly of the cleaning robot switches from the mop folding state to the mopping state; in case where the operating surface is a carpet, the wet cleaning assembly of the cleaning robot remains in the mop folding state; the judgement of the material of the operating surface can combine with relative technology to understand, for example, it can analysis and judge through the image of the operating surface captured by a camera, it can also analysis and judge through a optical sensor, or through an acoustic wave sensor or ultrasonic wave, etc., and there is no limit to this. It can be understood that, for the operating surfaces such as floor or ceramic tile, the cleaning can mop the floor through the wet cleaning assembly after sweeping through the dry cleaning assembly, ensuring that the floor or the ceramic tile ground can be cleaned more thoroughly. But to the operating surfaces such as the carpet, the mopping command cannot be executed, which will contaminate the carpet more easily, and only sweeping and vacuuming of the dry cleaning assembly can be performed. Therefore in order to enable the cleaning robot to execute correct cleaning command after finishing being hijacked, the state of the wet cleaning assembly must be controlled according to the material of the operating surface at the current position, in case where the operating surface is a floor or ceramic tile, controlling the wet cleaning assembly to switch from the mop folding state in case where being hijacked to the mopping state, to mop the floor or the ceramic tile; in case where the operating surface is a carpet, controlling the wet cleaning assembly to remain the mop folding state to avoid releasing the mop to contaminate the carpet.

Optionally, the wet cleaning assembly of the cleaning robot switches from the mopping state to the mop folding state, comprises:

the wet cleaning assembly of the cleaning robot changes from an expanded mopping state to a retracted mopping state firstly, and then changes from the retracted mopping state to the mop folding state. At this time, the mopping state of the correspondent wet cleaning assembly before being hijacked is that the mop for mopping the floor is expanded, in order to expand the cleaning area, some cleaning robots set a driving assembly on the wet cleaning assembly for driving the mop to expand, the wet cleaning assembly needs to expand beyond the outside of the body of the cleaning robot in case where the wet cleaning assembly is working, thus extending beyond the range of the body to increase the cleaning area, at this time, in order to avoid damaging the wet cleaning assembly by directly retracting the wet cleaning assembly, it is necessary to enable the wet cleaning assembly to retract to the retracted mopping state within the range of the body of the cleaning robot from the expanding state, and then changes from the mop folding state to the retracted mopping state.

Optionally, further comprising: in case where the wet cleaning assembly of the cleaning robot performs a cleaning task on the operating surface at least in a mopping state, and the cleaning robot is hijacked, a dry cleaning assembly of the cleaning robot reduces the rotation speed after a first preset time.

Optionally, the dry cleaning assembly comprises a cleaning edge brush, the first preset time for the cleaning edge brush to reduce the rotation speed is 1 to 5 s.

Optionally, further comprising: the dry cleaning assembly of the cleaning robot stops rotating after a second preset time.

Optionally, the second preset time for the cleaning edge brush to stop rotating is 25 to 35 s.

Optionally, further comprising: the dry cleaning assembly of the cleaning robot increases the rotation speed after reducing the rotation speed.

Optionally, in case where the wet cleaning assembly of the cleaning robot performs a cleaning task on the operating surface at least in a mopping state, and after the cleaning robot is being hijacked, the driving wheel of the cleaning robot accelerates in the range of a third preset time to escape from the hijacked state.

Optionally, in case where the driving wheel of the cleaning robot does not escape from the hijacked state in the range of the third preset time, stops rotating after a fourth preset time.

In the embodiment of the present disclosure, in case where the wet cleaning assembly of the cleaning robot is performing the cleaning task on the operating surface in the mopping state, once the cleaning robot is hijacked for more than the preset time, the wet cleaning assembly of the cleaning robot changes from the mopping state to a mop folding state, avoiding contamination to the operating surface caused by the water tank leakage. In case where the cleaning robot quits being hijacked, the cleaning robot controls the wet cleaning assembly to release to mop the floor or continue to remain folding state according to the material of the operating surface, to adapt to the material of the current operating surface and avoid contaminating the carpet.

Finally, it should be noted that each embodiment in this specification is described in a progressive manner. Each embodiment focuses on its differences from other embodiments. The same and similar parts between the various embodiments can be referred to each other. As for the system or device disclosed in the embodiment, since it corresponds to the method disclosed in the embodiment, the description is relatively simple. For relevant details, please refer to the description in the method section.

The above embodiments are only intended to illustrate the technical solutions of the present application, and not to limit them; although detailed descriptions have been provided for the aforementioned embodiments, those skilled in the art should understand that modifications can still be made to the technical solutions described in the embodiments, or equivalent substitutions can be made to some or all of the technical features; such modifications or substitutions do not depart from the scope of the technical solutions of the various embodiments of the present application.

The invention claimed is:

1. A control method for cleaning robot, wherein the method comprises:

in case where a wet cleaning assembly of the cleaning robot performs a cleaning task on the operating surface at least in a mopping state, the cleaning robot is being hijacked and the time of being hijacked is greater than a preset time, the wet cleaning assembly of the cleaning robot changes from the mopping state to a mop folding state, the being hijacked means that the cleaning robot leaves the operating surface, the mopping state means that the mop is in the state of being released;

the being hijacked means that the cleaning robot lifts off the ground completely under an action of external force, and the cleaning robot does not contact with the operating surface;

the cleaning robot quits being hijacked and continues to perform the cleaning task, in case where the operating surface is a floor or ceramic tile, the wet cleaning assembly of the cleaning robot switches from the mop folding state to the mopping state; and in case where the operating surface is a carpet, the wet cleaning assembly of the cleaning robot remains in the mop folding state.

2. The control method for cleaning robot according to claim 1, wherein the preset time is 0.5 s to 5 s.

3. The control method for cleaning robot according to claim 1, wherein the wet cleaning assembly of the cleaning robot switches from the mopping state to the mop folding state, comprises: the wet cleaning assembly of the cleaning robot changes from an expanded mopping state to a retracted mopping state firstly, and then changes from the retracted mopping state to the mop folding state.

4. The control method for cleaning robot according to claim 1, further comprising: in case where the wet cleaning assembly of the cleaning robot performs a cleaning task on the operating surface at least in a mopping state, and the cleaning robot is being hijacked and the time of being hijacked is greater than a preset time, a dry cleaning assembly of the cleaning robot switches from a sweeping state to a rotation stop state.

5. The control method for cleaning robot according to claim 4, wherein, the dry cleaning assembly comprises a cleaning roller brush and a cleaning edge brush, the preset time for the cleaning roller brush to stop rotating is 0.5 to 2 s, or the preset time for the cleaning edge brush to stop rotating is 0.5 to 2 s.

6. A control method for cleaning robot, wherein the method comprises:

in case where a wet cleaning assembly of the cleaning robot performs a cleaning task on the operating surface at least in a mopping state, the cleaning robot is being hijacked and the time of being hijacked is greater than a preset time, the wet cleaning assembly of the cleaning robot is in the mopping state, the being hijacked means that the cleaning robot leaves the operating surface, the mopping state means that the mop is in the state of being released;

the being hijacked means that the cleaning robot lifts off the ground completely under an action of external force, and the cleaning robot does not contact with the operating surface;

the cleaning robot quits being hijacked, the wet cleaning assembly of the cleaning robot switches from the mopping state to a mop folding state;

the cleaning robot continues to perform the cleaning task, in case where the operating surface is a floor or ceramic tile, the wet cleaning assembly of the cleaning robot switches from the mop folding state to the mopping state, in case where the operating surface is a carpet, the wet cleaning assembly of the cleaning robot remains in the mop folding state.

7. The control method for cleaning robot according to claim 6, wherein the preset time is 0.5 s to 5 s.

8. The control method for cleaning robot according to claim 6, wherein the wet cleaning assembly of the cleaning robot switches from the mopping state to the mop folding state, comprises: the wet cleaning assembly of the cleaning robot changes from an expanded mopping state to a retracted mopping state firstly, and then changes from the retracted mopping state to the mop folding state.

9. The control method for cleaning robot according to claim 6, further comprising: in case where the wet cleaning assembly of the cleaning robot performs a cleaning task on the operating surface at least in a mopping state, and the cleaning robot is being hijacked and the time of being hijacked is greater than a preset time, a dry cleaning assembly of the cleaning robot switches from a sweeping state to a rotation stop state.

10. The control method for cleaning robot according to claim 9, wherein the dry cleaning assembly comprises a cleaning roller brush and a cleaning edge brush, the preset time for the cleaning roller brush to stop rotating is 0.5 to 2 s, or the preset time for the cleaning edge brush to stop rotating is 0.5 to 2 s.

* * * * *